US006311628B1

(12) United States Patent
Smith et al.

(10) Patent No.: US 6,311,628 B1
(45) Date of Patent: Nov. 6, 2001

(54) SPILLAGE RETAINING FITMENT FOR PALLETS

(75) Inventors: Richard Anthony Smith, Middlethorpe; John Husband, Wellingborough, both of (GB)

(73) Assignee: Armagard Limited (GB)

( * ) Notice: Subject to any disclaimer, the term of this patent is extended or adjusted under 35 U.S.C. 154(b) by 0 days.

(21) Appl. No.: 09/202,468

(22) PCT Filed: Jun. 18, 1997

(86) PCT No.: PCT/GB97/01650

§ 371 Date: Mar. 15, 1999

§ 102(e) Date: Mar. 15, 1999

(87) PCT Pub. No.: WO97/48611

PCT Pub. Date: Dec. 24, 1997

(30) Foreign Application Priority Data

Jun. 19, 1996 (GB) ..... 961257
Mar. 26, 1997 (GB) ..... 9706226

(51) Int. Cl.[7] ..... B65D 19/44
(52) U.S. Cl. ..... 108/55.1
(58) Field of Search ..... 108/51.11, 53.3, 108/53.1, 57.29, 55.1, 55.3, 57.13, 54.1, 57.16, 57.25, 57.28, 901; 248/346.02; 206/446, 600

(56) References Cited

U.S. PATENT DOCUMENTS 2,725,087 * 11/1955 Potter ..... 206/600 X
4,195,732 * 4/1980 Bell ..... 206/386 X
4,361,232 11/1982 Olmsted .
5,052,307 10/1991 Morrison .
5,144,897 * 9/1992 Avery ..... 108/55.3
5,193,700 * 3/1993 Lyman et al. ..... 206/386 X

FOREIGN PATENT DOCUMENTS

4242472A1 6/1994 (DE) .
WO9324395 12/1993 (WO) .

* cited by examiner

*Primary Examiner*—Jose V. Chen
(74) *Attorney, Agent, or Firm*—Kelly, Bauersfeld Lowry & Kelley, LLP

(57) ABSTRACT

A fitment for mounting on a pallet to provide a bunded pallet wherein the fitment has a part supportable by the pallet and adapted to receive a load thereon and a retaining wall disposed at least partly to surround the base pall and adapted to retain any spillage there within.

30 Claims, 5 Drawing Sheets

FIG 5
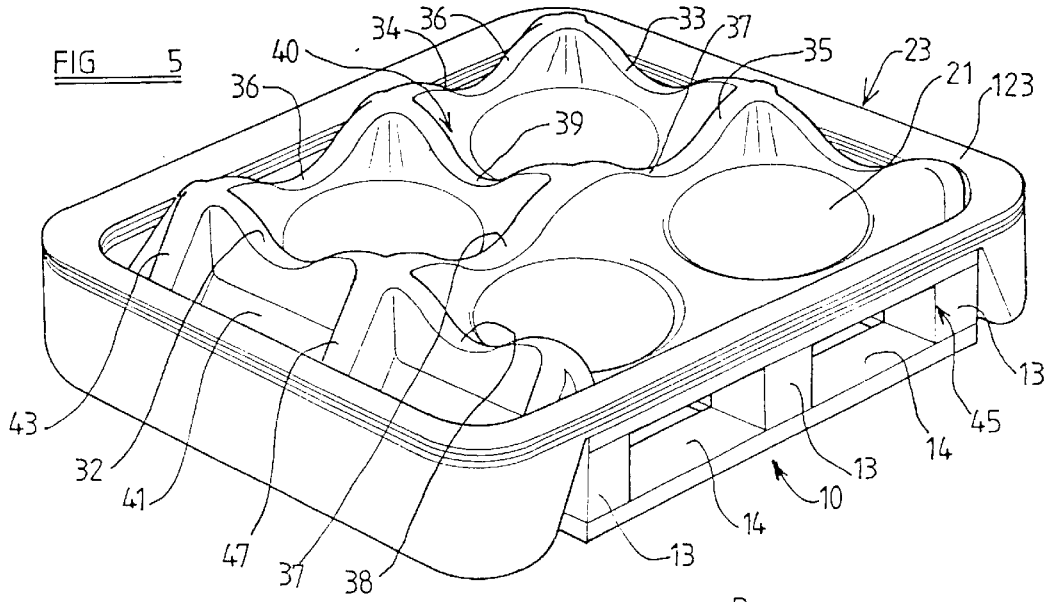
FIG 6
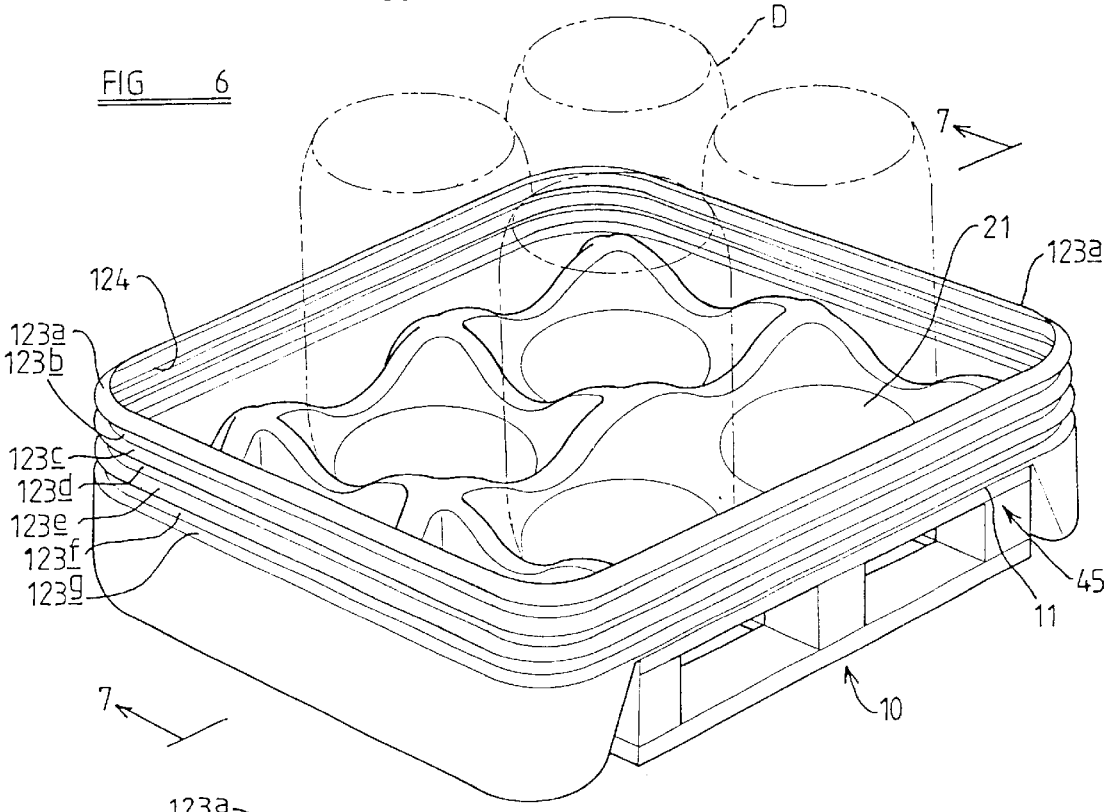
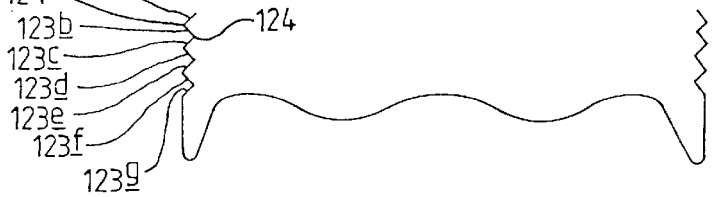
FIG 7

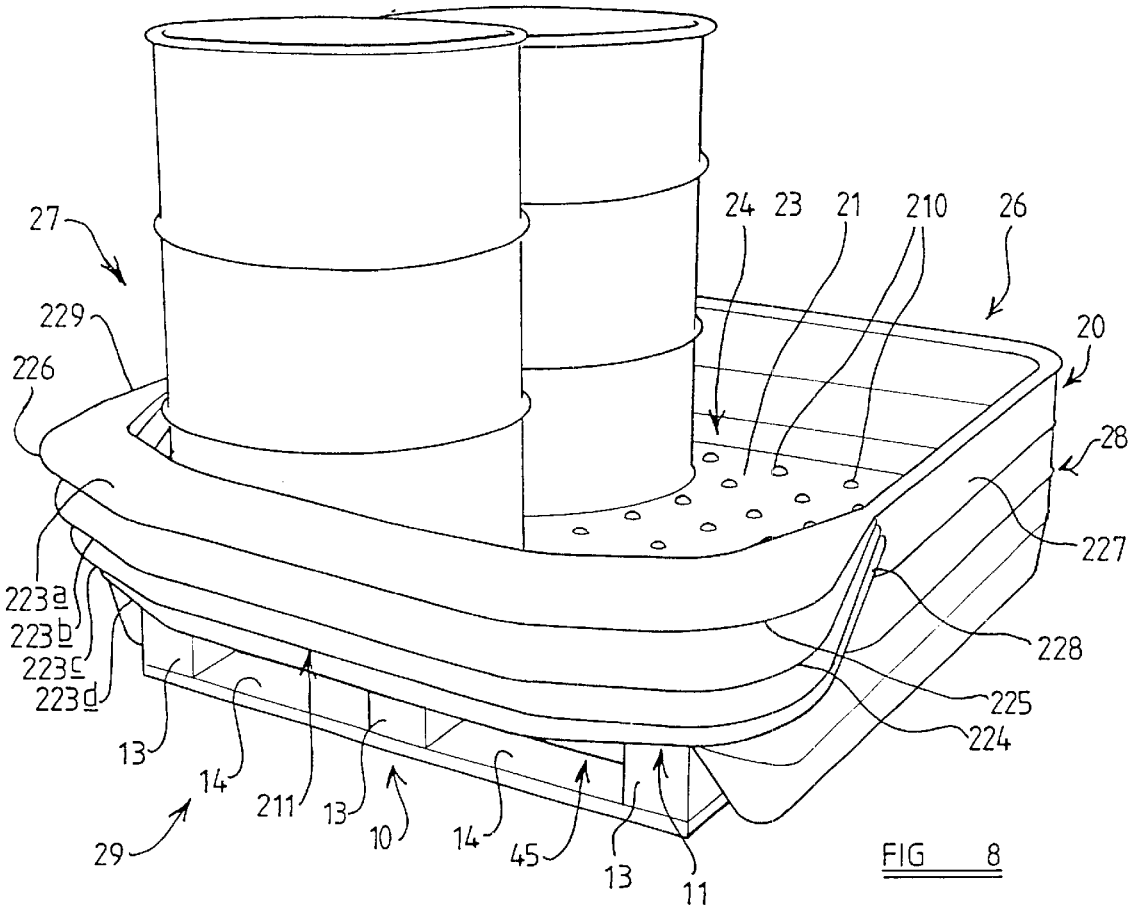
FIG 8
FIG 9
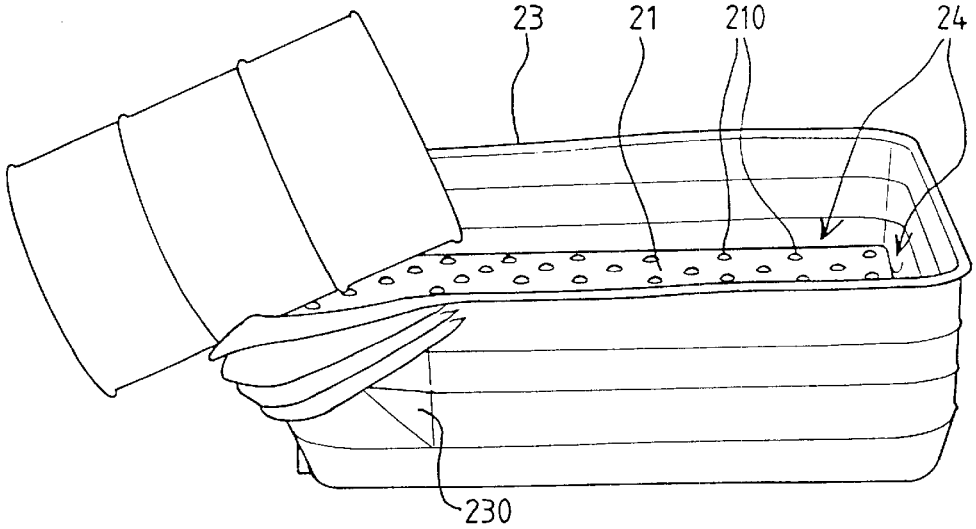

SPILLAGE RETAINING FITMENT FOR PALLETS

BACKGROUND OF THE INVENTION

This specification relates to a bunded pallet capable of preventing spillage from at least one container carried by the pallet.

It is known to provide a bunded pallet made as a plastics moulding but such a moulding is relatively expensive because it has to be strong enough to function as a pallet to carry the load imposed thereon in use.

An object of the present invention is to provide a bunded pallet whereby the above-mentioned problem is overcome or is reduced.

SUMMARY OF THE INVENTION

According to one aspect of the present invention we provide a fitment for mounting on a pallet to provide a bunded pallet wherein the fitment has a part supportable by the pallet and adapted to receive a load thereon and a retaining wall disposed at least partly to surround the base part and adapted to retain spillage there within.

The fitment may be provided with a recess in the underside thereof to receive the pallet and mount the fitment on the pallet. Accordingly, the fitment is a simple "slip-over" add-on device.

The fitment may be provided with a channel disposed at least partly to surround the base wall.

At least part of the channel may be at a level below the said base part.

The channel may comprise an outer wall part provided by said retaining wall, a bottom wall part disposed between the base wall and a connecting wall part which upstands from the bottom wall pall and which depends downwardly from the base part.

The top of the retaining wall may be substantially no higher than the top of the pallet. In this case, it is relative easily to load and offload a container.

In an alternative version, the top of the retaining wall may be considerably higher than the top surface of the pallet, for example, by up to 400 mm. In this case, although it is more difficult to load or offload a container, a greater amount of spillage may be retained.

In a further alternative version the retaining wall may be of variable height to facilitate loading when the retaining wall is of relatively small height and to retain a relatively large amount of fluid when the wall is a relatively large height.

All, or at least part of the retaining wall, may be formed so that the height thereof can be changed.

The retaining wall may comprise at least a part of generally "bellows" configuration.

The retaining wall may comprise a plurality of wall parts which are hinged together for movement between a relatively small height position in which the wall parts have a relatively smaller included acute angle mutually therebetween than the relatively large height position in which the wall parts have a relatively large included acute angle mutually therebetween. The wall parts may be hinged together by virtue of being formed integrally with each other.

The hinged together wall parts may comprise all or part of one side of the fitment or may comprise all of said sides or any desired combination of sides or parts thereof.

The variable height retaining wall may normally adopt a raised position but be deformable to a lower position by virtue of said hinged interconnection.

The base part of the fitment may be provided with a configuration to receive a load such as a container in at least one desired orientation or a further pallet which usually would carry at least one container or other item thereon.

The load may comprise a generally cylindrical container disposed in a first orientation with its longitudinally extending axis vertical. Thus a lower circular part of the container is horizontal and supported by the base part.

The base part may be configured to receive a plurality of containers such as four, in said first orientation.

Alternatively, or in addition, the base pale may be configured to receive at least one container in a second orientation with said longitudinal axis generally horizontal. If desired, the base part may be configured to receive two parallel containers in said configuration.

The base part may be provided with a plurality of upstanding walls which may be configured to provide seats to receive the or each container.

The upstanding walls of the base pale may comprise two side walls and two transverse walls, a front one of the transverse walls being displaced rearwardly from a front end of the fitment and the other transverse wall being disposed at or adjacent a rear of the fitment, or, if desired, at an intermediate position, the distance between the transverse walls being such as to support a container in an horizontal position. By virtue of displacing the front transverse wall inwardly, contents of the drum spilled onto the base part in front of the transverse wall may fall into the channel at the front of the fitment.

Where the fitment has a variable height retaining wall wherein only a part of the wall has a height which can be changed, said part may comprise all or part of said front wall.

The channel at the front of the fitment may be at or adjacent the top of the pallet and, hence, at or adjacent the level of the main part of the base wall. In this case the channel may extend, if desired, around only three sides or along only two opposite sides of the tray at a lower level than the base part and the channel at the front being at the same level as the base wall or at a reduced depth compared with the base part.

The side walls and, if desired, the real transverse wall may be provided with bracing webs connected to the bottom part of the channel. The webs may be arranged so that liquid can flow past the webs in the channel.

The pallet may be a conventional timber pallet.

The pallet may comprise an upper part which may comprise a plurality of parallel upper members, a lower part which may comprise a plurality of lower members parallel to said upper members and an intermediate part which may comprise a plurality of intermediate members disposed between and interconnecting said upper and lower parts. A socket means may be provided in the pallet below the upper part to receive a handling means.

According to a second aspect of the invention we provide a bunded pallet comprising a pallet having mounted thereon a fitment according to the first aspect of the invention.

The side walls may comprise a continuation of said connecting walls.

Two embodiments of the invention will now be described by way of example with reference to the accompanying drawings, wherein

BRIEF DESCRIPTION OF THE DRAWINGS

FIG. 5 is a perspective view of an alternative embodiment of the invention showing a variable height retaining wall at a relatively small height, FIG. 6 is a view of the tray of FIG. 5 but showing the retaining wall at a relatively large height, FIG. 7 is a cross section through a variable height retaining wall shown in FIGS. 5 and 6, FIG. 8 is a perspective view of a modification of the tray embodying the invention, and FIG. 9 is a fragmentary perspective view of a part of the tray of FIG. 8.

DETAILED DESCRIPTION OF THE PREFERRED EMBODIMENTS

Figure 1:
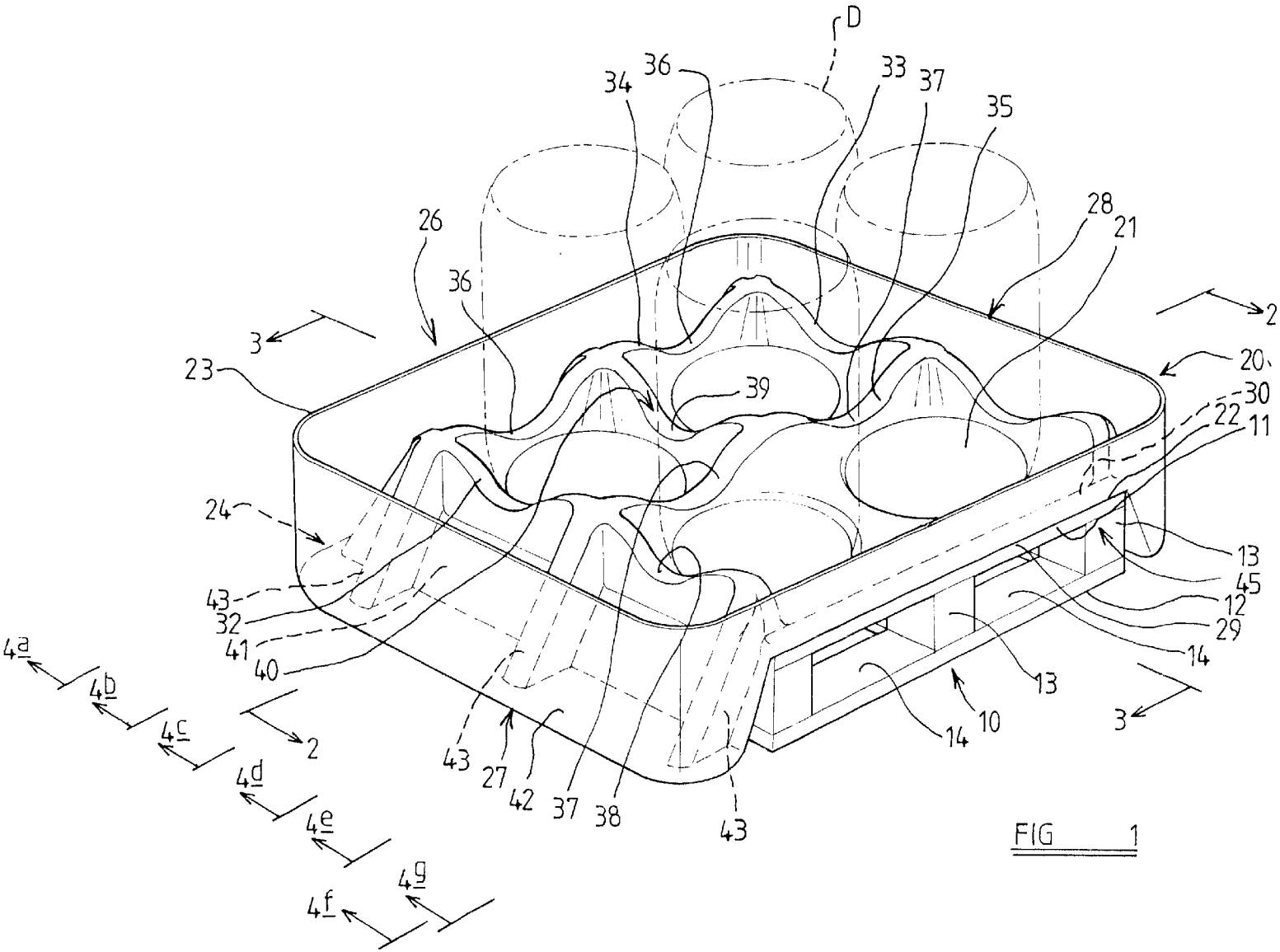
FIG. 1 is a perspective view of a tray for use with a pallet embodying the invention.

A conventional pallet is indicated generally at 10 and comprises an upper part 11 comprising a plurality of parallel wooden slats, a lower part 12 comprising a further plurality of lower wooden slats which are parallel to the slats 11 and three connecting members 13 which are connected to the upper and lower slats which extend therebetween so as to connect them together to form a pallet.

The pallet provides handling sockets 14 for, for example, the forks of a forklift truck whereby the pallet may be lifted and manoeuvred as desired.

In order to render the conventional wooden pallet 10 a bunded pallet to restrain ullage or other liquid spillage from generally cylindrical drum-shaped containers D a fitment, comprising a tray 20, is provided. The tray 20 comprises a base part, comprising a base wall 21, at a level so as to be supported by an upper surface 22 of the pallet 11. The base wall 21 is surrounded by a retaining wall 23. The base wall 21 is provided with a channel 24 outwardly of the base wall 21. In this example, the channel 24 extends around the whole of the base wall so as to extend around a rear 26, two sides 27,28 and a front 29 of the tray. The channel 24 is disposed in part below the base wall 21 where it extends around the side walls 27,28 and rear 26 and is at or substantially at the same level as the base wall 21 in the region thereof 30 which extends past the front 29. If desired, the channel 24 may be at a lower height in the region 30 consistent with providing access for the forks. If desired, the channel 24 may be omitted completely in the region of the front 29 so that liquid is allowed to fall only into the sides 27,28 of the channel as well as at the rear 26.

The base wall 21 is provided with a pair of side walls 32,33 parallel to the sides 27,28 and a rear transverse wall 34 parallel to the rear 26 and a front transverse wall 35 at a position disposed rearwardly of the front 29 but at a distance so that when the drums D are disposed with their longitudinal axes L horizontal, the drums project forwardly of the wall 35 so that any spillage on the base wall 21 forwardly of the front transverse wall 35 can fall into the channel 24. The walls 32–35 are formed with a configuration to receive a pair of the drums D in a vertical orientation as shown at $D_V$ in FIGS. 2 and 3 and in a horizontal configuration as shown at $D_H$, in FIGS. 2 and 3. In the present example, the configuration of the tops of the walls 32–35 is of pall-circular shape as indicated as 36 in the rear wall and 37 in the front intermediate wall. An intermediate wall 39 is provided between the front and rear transverse walls 35,36 and is also provided at the top with drum receiving formations of part-circular configuration as shown at 40.

Figure 2:
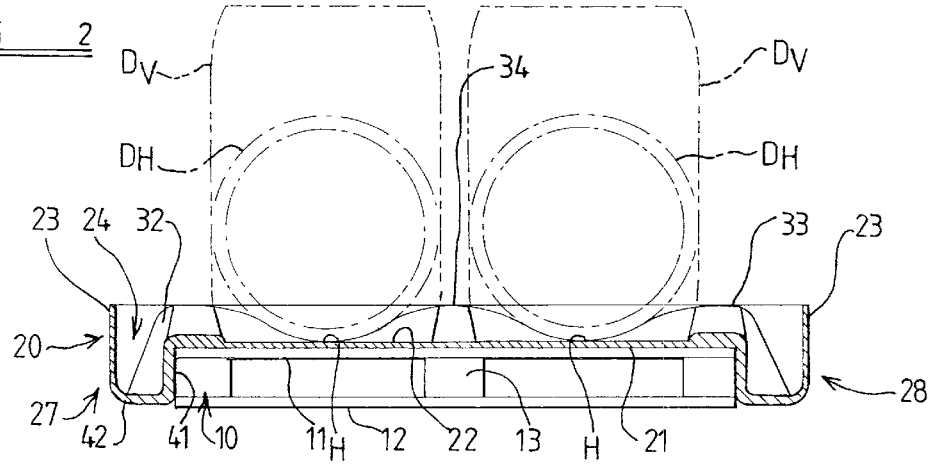
FIG. 2 is a section on the line 2—2 of FIG. 1.
Figure 3:
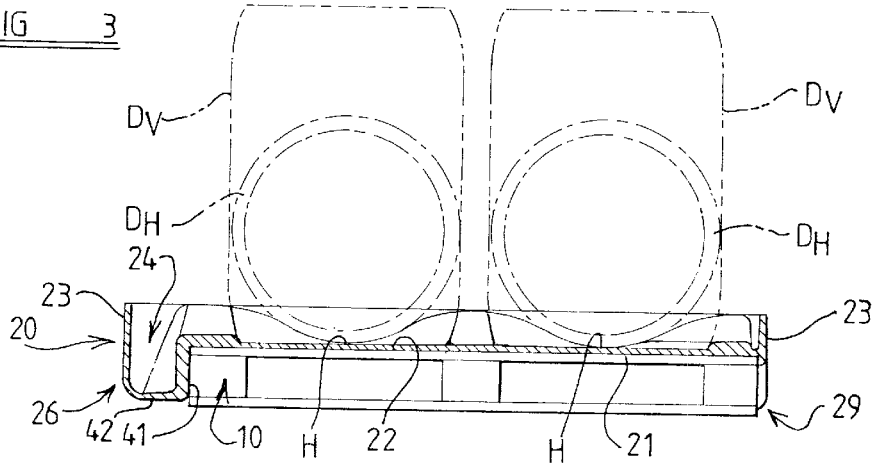
FIG. 3 is a section on the line 3—3 of FIG. 1, FIGS. 4*a–g* show diagrammatically a cross-section through the tray taken on the lines 4*a–g,*
Figure 4A:
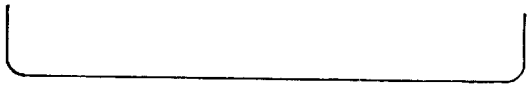
Figure 4B:
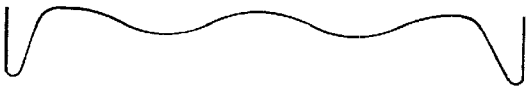
Figure 4C:
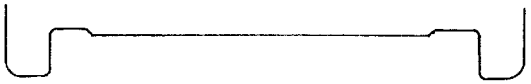
Figure 4D:
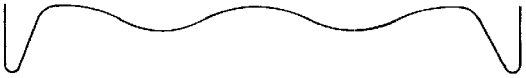
Figure 4E:
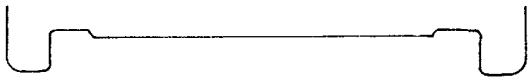
Figure 4F:
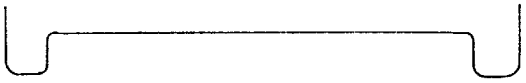
Figure 4G:
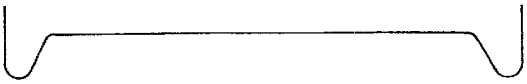
Figure 10:
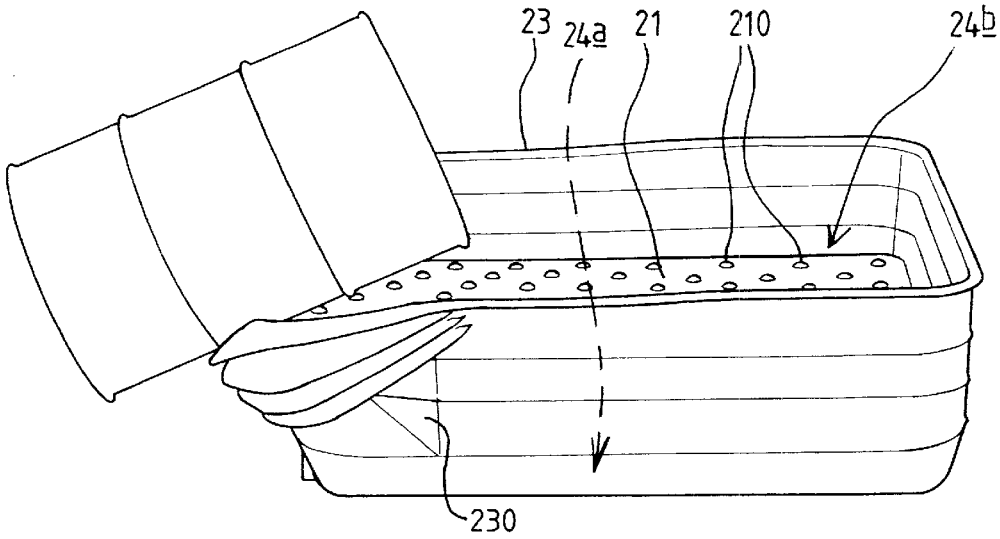
FIG. 10 is a further perspective view of the tray of FIG. 8.

Between the upstanding side transverse and intermediate walls the sides of which are inclined, as illustrated, the base wall 21 is provided with four generally planar disc-shaped parts of a circular configuration to receive the end surfaces of the drums D when the drums are disposed as illustrated in FIG. 1 and when the drums are disposed in the vertical position as shown in $D_V$ in FIGS. 2 and 3.

The side walls 32,33 are formed as upstanding vertical extensions of generally inclined connecting wall parts 41 which serve to connect a bottom part 42 of the channel 24 to the base wall 21 and, of course, to the upstanding side walls 32,34 and similarly to the rear transverse wall 34. If desired, the bottom part 42 of the channel may be braced by, for example, three web members 43 extending between the bottom wall part 42 and the connecting wall part 41 and upstanding walls 32,33,34 as desired.

In consequence of the above-described configuration, the tray 20 is provided with a recess 45, on the underside thereof, which receives the pallet 10 and mounts the tray on the pallet. It will be appreciated that the recess is configured so as to provide a co-operating fit with the top of the pallet 10 whereby the tray is made a simple "slip-on" add-on device.

In the present example, the fitment is made as a vacuum moulding in a suitable synthetic plastics material such as polyethylene, the plastics material being relatively thin, for example 2–4 mm thick although any part or all of the fitment may be thicker as desired, for instance where reinforcement of the fitment is necessary. If desired, the fitment may be made of any other suitable material and/or in any other suitable way such as by rotational moulding or blow moulding.

In the illustration shown in FIGS. 1 to 4, the drums, when positioned horizontally as shown at $D_H$, are ready for decanting at the front 29 of the tray. If desired, however, the two drums may be disposed at 90° to the position shown in the figures and decanted in this orientation. If desired, when the drums are horizontal one could be disposed so as to decant in one direction and the other disposed so as decant at 180° to the first-mentioned drum.

If desired, the base part may be of any desired configuration to suite a load to be carried by a pallet. Although in the present example the base pall has four generally planar disc shaped parts of circular configuration to receive the end surface of the drums the underside of which disc shaped parts are supported directly by the upper surface of the pallet so that the load of the drums is transmitted to the pallet directly through the disc shaped parts so that the material of the disc shaped parts simply carries the load in direct compression if desired the pallet may have a base part which includes a portion which directly engages an upwardly facing surface of the pallet with the undersurface of a pallet engaging part of the base whilst the load to be carried may be carried by another part of the base so that the load is not transmitted simply by the material of the pallet engaging part in compression. For example when the drums are carried in the horizontal configuration shown in FIGS. 2 and 3 under the reference numeral DH. If desired, however, the upstanding walls may have a proportion of their reduced height part which is of the same height of the above mentioned disc shaped parts so that the majority at least, of the weight of the load when the drums are horizontal is transmitted by a pallet engaging part of the tray which comprises simply a portion of the base part sandwiched so as to be in compression, directly between the load and the upwardly facing surface of the pallet at H.

Referring now to FIGS. 5 and 6 an alternative embodiment is illustrated which is of the same configuration as the pallet described hereinbefore and in which the same reference numerals have been used to refer to corresponding parts as have been used in the preceding figures. The pallet of the present embodiment differs from that of the previous embodiment simply by virtue of the configuration of the retaining wall 23. In this embodiment the retaining wall 23 is of generally bellows configuration comprising a plurality of sections 123*a*–123*g* as best shown in FIG. 7. The wall parts 123*a*–123*g* are hinged together at the inner and outer regions of joinder 124 by virtue of the wall parts 123*a*–123*g* being all made integral with each other. The wall parts are movable like a bellows between a relatively small height position shown in FIG. 5 in which the wall parts 123*a*–123*g* have a small included acute angle therebetween and a relatively large height position shown in FIG. 6 in which the all parts 123*a*–123*g* are relatively large included acute angle mutually therebetween. In the position shown in FIG. 5 since the wall has a relatively low height, loading of a pallet fitted with the fitment is facilitated whilst when the wall is in the raised position shown in FIG. 6 a relatively large amount of fluid can be retained by the fitment.

The material of the bellows may be the same as the remainder of the pallet and it may be formed integrally therewith and made separately and attached thereto by any suitable means. The material of the bellows likewise may be of any suitable material or may be of the same material as the pallet and, if desired, the wall parts may be made separately and joined together at the position of joinder 124 in any desired manner.

When the bellows contain spillage they are relatively self-supporting and so stay in an extended condition. They allow relatively easy loading and off loading because they will naturally collapse to their low height position if a load is manhandled over them and then spling back into shape. Accordingly the wall may be normally in a generally raised condition but, if desired, the wall may be constructed so that it may be raised manually and generally retained therein if desired and then it may be manually lowered or allowed to be lowered as a result of a load being imposed thereon.

The channel 24 in this embodiment is provided on only three sides and is not provided at the front of the fitment.

Referring now to FIGS. 8 to 11, another embodiment of the invention is illustrated which is a similar configuration to the pallet described hereinbefore and in which the same reference numerals have been used to refer to corresponding parts as have been used in the preceding figures. The pallet of the present embodiment differs from that of the previous embodiment by virtue of the configuration of the retaining wall 23 and the configuration of the base wall 21 which, in this embodiment, is generally planar except for upstanding part-spherical anti-slip projections 210 distributed over the surface of the base wall 21. If desired, in this embodiment, the base wall 21 may be provided with side, front and rear walls 32–35, as described previously. An abutment 50 comprising a generally planar and vertical face 50*a* is provided to engage the pallet when the fitment is in place.

Another difference between this embodiment and the previous embodiment is that the retaining wall 23 is of generally bellows configuration over only a part of the periphery thereof. In this embodiment, the front part 211 of the retaining wall 23 is made of generally bellows configuration comprising a plurality of sections similar to the sections 123*a*–123*g* of the previous embodiment where, in this embodiment, only upper ones of the sections 123*a*, 123*g* are shown in the present example at 223*a*–*d*. The wall parts are hinged together at the inner and outer regions of joinder 224, by virtue of all being made integral with each other, as best shown in FIG. 9. The wall parts are movable like a bellows between a relatively small height position shown in FIG. 10 where a drum can conveniently be loaded onto the fitment and a relatively large height position shown in FIG. 8. The bellows-like part of the front wall described hereinbefore will spring back to the position shown in FIG. 8 from the depressed position it is caused to adopt by the load of the drum imposed upon it.

Figure 11:
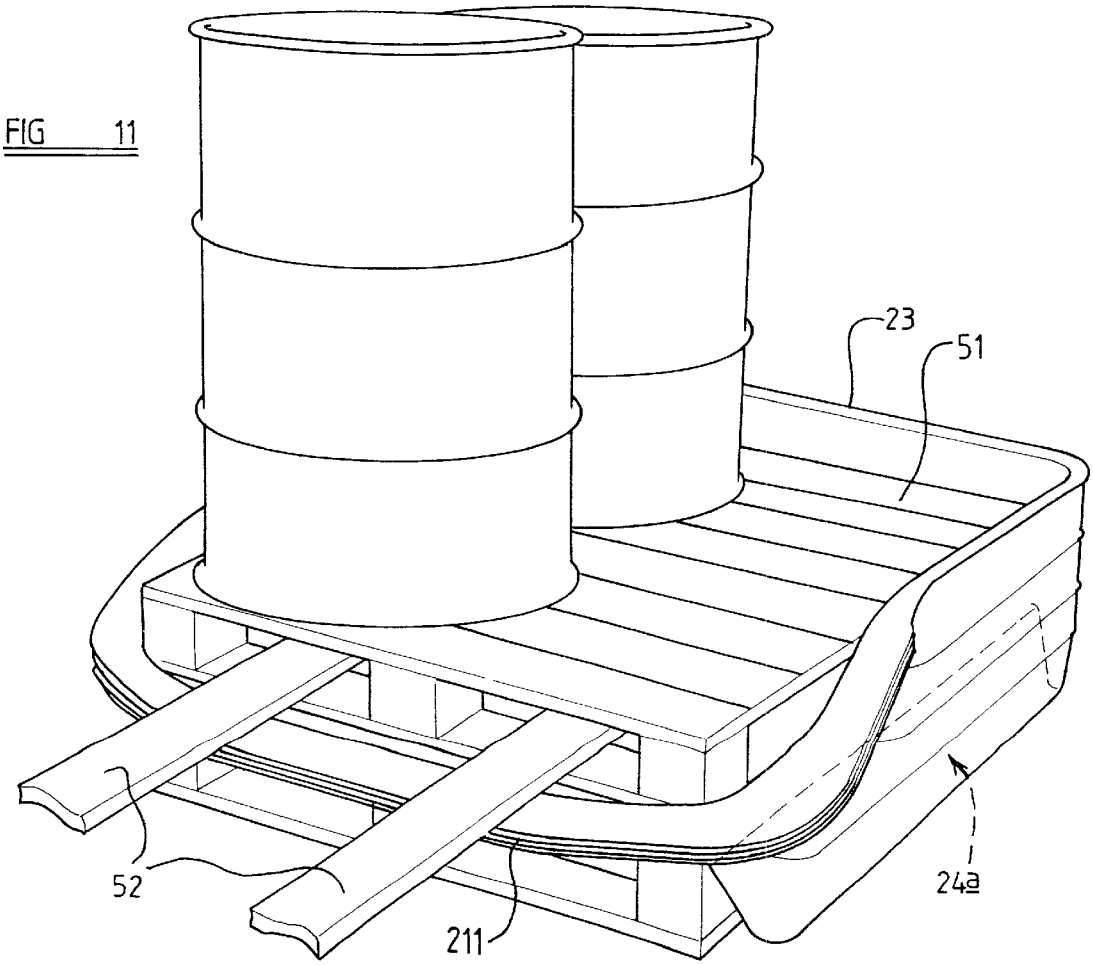
FIG. 11 is a still further perspective view of the tray of FIG. 8.

If it is desired to load the fitment with, for example a further conventional pallet 51, or drum, or the like, into the fitment with, for example, a forklift truck, then the bellows-like part 211 can be displaced to a position similar to that shown in FIG. 11 by the forks 52 of the forklift truck during loading and then spring back to the position shown in FIG. 8 after the forks have been removed.

As can be seen in FIGS. 8 and 9, the bellows-like part 211 extends around opposite corner parts 225, 226 and are joined to non-changeable height parts of the wall 227 by inwardly inclined parts 228, 229 of the bellows-like wall part. In the region of the inclined parts 228, 229, the lower bellows section 223*d* is provided with a generally triangular part 230 which lies in a generally vertical plane containing the edge part 230*a*. The generally triangular part 230 is joined at its lower edge 230*b* to the wall of the channel 24*a* and the bottom of the front part 211 by means of an inwardly directed corner part 231. The inwardly directed corner part 231 is joined at its upper edge 232 to the bellows section 223*d*.

In the embodiment of FIGS. 8 to 11 channel 24 comprises two separate channel parts 24*a* and 24*b* disposed on the opposite sides of the fitment whilst the base wall 21 extends in the same plane between and up to the rear and front walls. If desired any feature, for example, the channel 24, as described with reference to any one of the above embodiments may be provided mutatis mutandis in another embodiment.

The features disclosed in the foregoing description, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

What is claimed is:

1. A fitment for mounting on a pallet to provide a bunded pallet wherein the fitment has a base part supportable by the pallet and adapted to receive a load thereon and a retaining wall disposed at least partly to surround the base part and adapted to retain any spillage there within, wherein the fitment is provided with a channel disposed at least partly to surround the base part and wherein at least part of the channel is at a level below the said base part.

2. A fitment according to claim 1 wherein the fitment is provided with a recess in the underside thereof to receive the pallet and mount the fitment on the pallet.

3. A fitment according to claim 1 wherein the channel comprises an outer wall part provided by said retaining wall, a bottom wall part disposed between the base part and a connecting wall part which upstands from the bottom wall part and which depends downwardly from the base part.

4. A fitment according to claim 1 wherein the top of the retaining wall is substantially no higher than the base part.

5. A fitment according to claim 1 wherein the top of the retaining wall is considerably higher than the base part.

6. A fitment according to claim 1 wherein the retaining wall includes hinged together wall parts comprising all sides of the fitment.

7. A fitment according to claim 1 wherein the base part of the fitment is provided with a configuration to receive said load in at least one desired orientation.

8. A fitment according to claim 7 wherein the base part is configured to receive said load comprising at least one generally cylindrical container such that said at least one container is supported in a second orientation with its longitudinally extending axis generally horizontal, the base part comprising a plurality of upstanding walls to support said container.

9. A fitment according to claim 8 wherein the base part is configured to receive two parallel containers in said second orientation.

10. A fitment according to claim 8 wherein said plurality of upstanding walls are configured to provide seats to receive the or each container.

11. A fitment according to claim 10 wherein the upstanding walls of the base part comprises two side walls and two transverse walls, a front one of the transverse walls being displaced rearwardly from a front end of the fitment and the other transverse wall being disposed at or adjacent a rear of the fitment, or at an intermediate position, the distance between the transverse walls being such as to support the container in an horizontal position.

12. A fitment according to claim 11 wherein the front transverse wall is displaced inwardly such that contents of container spilled onto the base part in front of the transverse wall fall into the channel at the front of the fitment.

13. A fitment according to claim 11 wherein the channel comprises an outer wall part provided by said retaining wall, a bottom wall part disposed between the base part and a connecting wall part which upstands from the bottom wall part and which depends downwardly from the base part and the side walls comprise a continuation of said connecting walls.

14. A fitment according to claim 1 wherein another part of the channel is disposed at the front of the fitment at or adjacent the level of the base part.

15. A fitment according to claim 1 wherein the channel extends around three sides of the fitment at a lower level than the base part and the channel at the front is at the same level as the base part or at a reduced depth compared with the base part.

16. A fitment according to claim 1 wherein the channel extends along two opposed sides of the fitment at a lower level than the base part, and the channel at the front and rear is at the same level as the base part or at a reduced depth compared with the base part.

17. A fitment for mounting on a pallet to provide a bunded pallet wherein the fitment has a base part supportable by the pallet and adapted to receive a load thereon and a retaining wall disposed at least partly to surround the base part adapted to retain any spillage there within, wherein the top of the retaining wall is considerably higher than the base part, the retaining wall being of variable height to facilitate loading when the retaining wall is a relatively small height and to retain a relatively large amount of fluid when the wall is a relatively large height, wherein only a part of the wall has a height which can be changed and said part comprises all or part of one side of the fitment.

18. A fitment according to claim 17 wherein the retaining wall comprises a plurality of wall parts which are hinged together for movement between a relatively small height position in which the wall parts have a relatively smaller acute included angle mutually therebetween and a relatively large height position in which the wall parts have a relatively large included angle acute mutually therebetween.

19. A fitment according to claim 18 wherein wall parts are hinged together by virtue of being formed integrally with each other.

20. A fitment according to claim 18 wherein the hinged together wall parts comprise all or part of a front wall comprising a front part of the retaining wall.

21. A fitment according to claim 18 wherein the variable height retaining wall may normally adopt a raised position but is deformable to a lower position by virtue of said hinged interconnection.

22. A fitment according to claim 17 wherein the fitment is provided with a channel disposed at least partly to surround the base part and said fitment comprises at least one side wall and a rear transverse wall, and at least one of the at least one side walls and the rear transverse wall is provided with bracing webs connected to a bottom part of the channel.

23. A fitment according to claim 22 wherein the webs are arranged so that liquid can flow past the webs in the channel.

24. A bunded pallet, comprising:

a fitment mounted on a pallet, wherein the fitment has a base part supportable by the pallet and adapted to receive a second pallet thereon and a retaining wall at least disposed at least partly to surround the base part and adapted to retain any spillage there within, wherein the fitment is provided with a channel disposed at least partly to surround the base part, and wherein at least part of the channel is at a level below the base part.

25. A bunded pallet, comprising:

a fitment mounted on a pallet, wherein the fitment has a base part supportable by the pallet and adapted to receive a generally cylindrical container disposed in a first orientation with its longitudinally extending axis vertical, such that a lower circular part of the container is horizontal and supported by the base part, wherein the fitment includes a retaining wall disposed at least partly to surround the base part and adapted to retain any spillage there within, wherein the fitment is provided with the channel disposed at least partly to surround the base part, and wherein part of the channel is at a level below the base part.

26. A fitment according to claim 25 wherein the base part is configured to receive a plurality of containers such as four, in said first orientation.

27. A bunded pallet, comprising:

a fitment mounted on a pallet, wherein the fitment has a base part supportable by the pallet and adapted to receive a load thereon and a retaining wall disposed at least partly to surround the base part and adapted to retain any spillage there within, wherein the fitment is provided with a channel disposed at least partly to surround the base part and wherein at least part of the channel is at a level below the said base part.

28. A bunded pallet according to claim 27 wherein the pallet is a conventional timber pallet.

29. A bunded pallet according to claim 28 wherein the pallet comprises an upper part which comprises a plurality of parallel upper members, a lower part which comprises a plurality of lower members parallel to said upper members and an intermediate part which comprises a plurality of intermediate members disposed between and interconnecting said upper and lower parts.

30. A fitment according to claim 29 wherein a socket means is provided in the pallet below the upper part to receive a handling means.

* * * * *

UNITED STATES PATENT AND TRADEMARK OFFICE

CERTIFICATE OF CORRECTION

PATENT NO. : 6,311,628 B1
DATED : November 6, 2001
INVENTOR(S) : Richard Anthony Smith and John Husband It is certified that error appears in the above-identified patent and that said Letters Patent is hereby corrected as shown below:

Title page,
Item [30], Foreign Application Priority Data, the first priority application number is -- 9612757 --.

Signed and Sealed this

Twenty-third Day of April, 2002

*Attest:*

*Attesting Officer*

JAMES E. ROGAN
*Director of the United States Patent and Trademark Office*